US009815621B2

(12) United States Patent
Blanchetiere et al.

(10) Patent No.: US 9,815,621 B2
(45) Date of Patent: Nov. 14, 2017

(54) HARBOUR STORAGE FACILITY FOR LIQUID FUEL

(71) Applicant: GDF Suez, Courbevoie (FR)

(72) Inventors: Gael Blanchetiere, Paris (FR); Jacky Doumenjou, Paris (FR); Stephan Lavenu, Paris (FR); Frédéric Legrand, Paris (FR); Hugues Malvos, Fontenay sous Bois (FR); Marc Perrin, Nogent sur Marne (FR); Patrick Subreville, Ferriere Haut Clocher (FR); Christophe Tastard, Plougoumelen (FR); Stéphanie Brodin, Ognon (FR)

(73) Assignee: Engie, Courbevoie (FR)

( * ) Notice: Subject to any disclaimer, the term of this patent is extended or adjusted under 35 U.S.C. 154(b) by 0 days.

(21) Appl. No.: 14/892,113

(22) PCT Filed: Apr. 11, 2014

(86) PCT No.: PCT/FR2014/050894
§ 371 (c)(1),
(2) Date: Nov. 18, 2015

(87) PCT Pub. No.: WO2014/188096
PCT Pub. Date: Nov. 27, 2014

(65) Prior Publication Data

US 2016/0096682 A1 Apr. 7, 2016

(30) Foreign Application Priority Data

May 23, 2013 (FR) ..... 13 54655

(51) Int. Cl.
*B65D 88/78* (2006.01)
*E02B 3/06* (2006.01)

(52) U.S. Cl.
CPC ..... *B65D 88/78* (2013.01); *E02B 3/066* (2013.01)

(58) Field of Classification Search
CPC ..... E02D 23/02; E02D 27/18; E02D 27/20; G65D 88/78
See application file for complete search history.

(56) References Cited

U.S. PATENT DOCUMENTS 3,464,212 A * 9/1969 Kamisaka ..... E02B 3/06 114/264
3,828,565 A * 8/1974 McCabe ..... F17C 3/02 114/256

(Continued)

FOREIGN PATENT DOCUMENTS

FR 2 894 646 6/2007
FR 2 980 164 3/2013

(Continued)

OTHER PUBLICATIONS

PCT/FR2014/050894 International Search Report dated Jun. 27, 2014 (6 pages).

*Primary Examiner* — Benjamin Fiorello
(74) *Attorney, Agent, or Firm* — Brinks Gilson & Lione; G. Peter Nichols

(57) ABSTRACT

An installation for the in-port storage of liquid fuel, which is formed near a dock, is formed of at least an upper surface substantially parallel to the free surface of the sea and a frontal surface adjacent to the upper surface and partially immersed. The installation includes at least one module having a floating caisson containing a fluidtight tank that may contain liquid fuel and having a closed contour formed of an upper face, a lower face, and several lateral faces. The module is fixed to the dock by anchoring means connecting one of the lateral faces of the caisson to the frontal surface (Continued)

Figure 1:
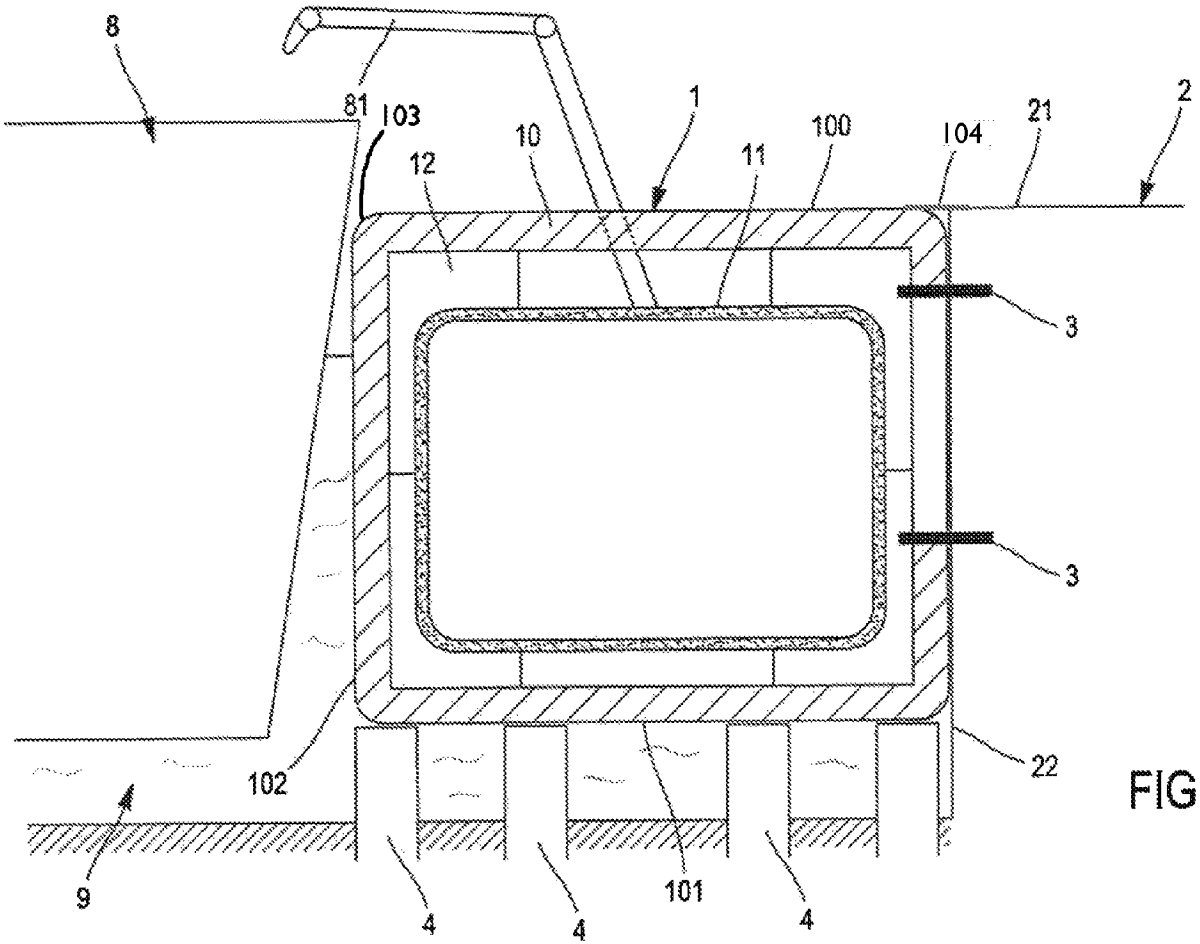

of the dock, the lower face and the lateral faces of the caisson therefore being at least partially immersed.

8 Claims, 2 Drawing Sheets

(56) References Cited

U.S. PATENT DOCUMENTS

| | | | | |
|---|---|---|---|---|
| 3,855,809 | A | 12/1974 | Westling | |
| 3,938,341 | A * | 2/1976 | Prins | B65D 88/78 405/210 |
| 4,188,157 | A | 2/1980 | Vigander | |
| 5,803,659 | A * | 9/1998 | Chattey | E02B 3/06 405/204 |
| 6,017,167 | A * | 1/2000 | Chattey | E02B 3/06 405/204 |
| 6,082,931 | A * | 7/2000 | Hopper | E02B 3/06 114/256 |
| 6,786,166 | B1 * | 9/2004 | Marchand | B63B 5/16 114/74 R |
| 8,297,885 | B2 * | 10/2012 | Grinberg | E02D 23/02 405/13 |
| 2004/0045490 | A1 * | 3/2004 | Goldbach | B65D 88/78 114/257 |
| 2012/0205217 | A1 * | 8/2012 | Birkeland | E02B 3/20 198/339.1 |
| 2014/0369765 | A1 | 12/2014 | Fargier | |

FOREIGN PATENT DOCUMENTS

| | | |
|---|---|---|
| GB | 2 403 690 | 1/2005 |
| WO | WO 99/54235 | 11/1999 |
| WO | WO 2006/041312 | 4/2006 |
| WO | WO 2013/002648 | 1/2013 |

* cited by examiner

HARBOUR STORAGE FACILITY FOR LIQUID FUEL

This application claims priority to International Application No. PCT/FR2014/050894 filed Apr. 11, 2014 and to French Application No. 1354655 filed May 23, 2013; the entire contents of each are incorporated herein by reference.

FIELD OF THE INVENTION

The present invention relates to the field of the storage of liquid fuel, such as liquid natural gas.

More specifically, the invention relates to an installation for the in-port storage of liquid fuel.

SOLUTIONS OF THE PRIOR ART

In order to allow ships to refuel during their various voyages, it is known practice, notably from document FR2980164, to use, right out at sea, liquid fuel storage and resupply stations so as to allow passing ships to refuel.

However, one disadvantage with such stations is that they require the ships to make an additional stopover in order to refuel, in addition to the stop for loading/unloading goods or passengers at the various ports. Such a solution therefore proves to be costly in terms of time and may give rise to delays, and this is unsatisfactory.

There are also solutions that use structures moored in port. Such structures are brought alongside the dock and allow the ships to refuel in parallel with the loading/unloading of goods.

However, such a technique presents a problem of space occupancy because it necessarily encroaches upon the portside and therefore reduces the mooring space available for the ship. Moreover, such a technique has to be positioned near a ship, which means that such structures have to change place relatively frequently in order to take account of the position of the ships. Such a technique therefore proves to be relatively difficult and expensive to use and to maintain, and this is unsatisfactory also.

OBJECTIVES OF THE INVENTION

A notable objective of the invention is to at least partially rectify the disadvantages of the prior art.

More specifically, one objective of at least one embodiment of the invention is to provide an installation which allows ships to be refueled with liquid fuel without thereby increasing the number of stops these ships have to make.

Another objective of at least one embodiment is to provide such an installation the dockside space occupancy of which is limited if not eliminated and that requires little or no modifications in order to use it.

Yet another objective of at least one embodiment is to provide an installation that is simple and inexpensive to implement.

SUMMARY OF THE INVENTION

These objectives, together with others that will become apparent hereinafter, are achieved using an installation for the in-port storage of liquid fuel, which is formed near a dock, the said dock being formed of at least:

- an upper surface substantially parallel to the free surface of the sea;
- a frontal surface adjacent to the upper surface and partially immersed, the installation comprising at least one module having a floating caisson containing a fluidtight tank that may contain liquid fuel, such as LNG (liquid natural gas), the caisson having a closed contour formed of an upper face, a lower face, and of several lateral faces.

According to the invention, the module is fixed to the dock by anchoring means connecting one of the lateral faces of the caisson to the frontal surface of the dock, the lower face and the lateral faces of the caisson therefore being at least partially immersed.

Thus, the invention proposes a novel and inventive approach that allows the disadvantages of the prior art to be rectified at least in part. Notably the solution proposed makes it possible to provide an installation which offers the possibility of the ships refueling with liquid fuel without thereby increasing the number of stops that these ships have to make. Specifically, the ships can refuel and load/unload their goods at the same time given that they are in dock.

Moreover, the dockside space occupancy is limited because the module is not placed or fixed on the upper surface of the dock but on the frontal surface thereof.

Furthermore, the invention proves simple and inexpensive to implement because it requires no modifications to the infrastructures present in the dock or on the ship but simply requires the use of module attachment means.

In one particular embodiment, the upper face of the caisson is formed substantially in the continuation of the upper surface of the dock.

As a result, the installation not only makes it possible not to encroach on the dockside space and therefore on the mooring area but also allows this mooring zone to be enlarged by providing a bigger zone.

In one alternative form the lower face of the caisson rests on columns fixed to the sea bed.

Thus, that allows the caisson to be held in place and the forces applied on the anchoring means, notably forces due to the weight of the caisson and forces due to the marine current, to be limited.

According to yet another alternative form, these columns are hollow.

According to another embodiment, a space is formed between the caisson and the tank of the module.

Such a space allows the tank containing the liquid fuel to be even better confined by keeping it away from the edges of the module.

In that case, the module may comprise compartments created in this space.

As a result of this, it becomes possible to position control, safety, cooling means, for example. These means are thus inside the module and therefore protected.

In an alternative form of the installation, the caisson has a substantially parallelepipedal contour.

This contour thus allows the module to be inserted relatively easily into the environment in which it is supposed to move around, namely pressing up against the dock. Furthermore, it is easier to juxtapose modules along a dock.

Ideally, this caisson may extend over the total length of the dock, thereby forming a new dockside surface along the dockside.

In one embodiment of the installation, the caisson has corner edges connecting the lateral, upper and lower faces, and these corner edges are rounded.

These rounded corner edges make it possible to limit the risk of knocks causing damage to ships when such ships are moored near the caissons.

According to one embodiment of the installation, the caisson is made of concrete.

Thus, the consequences of the force due to the mass of the module are limited by the reverse thrust afforded by the sea.

In an alternative form, the module is fixed removably to the dock.

That means that such modules can be handled more easily, notably when they need to be repaired or replaced.

LIST OF FIGURES

Figure 2:
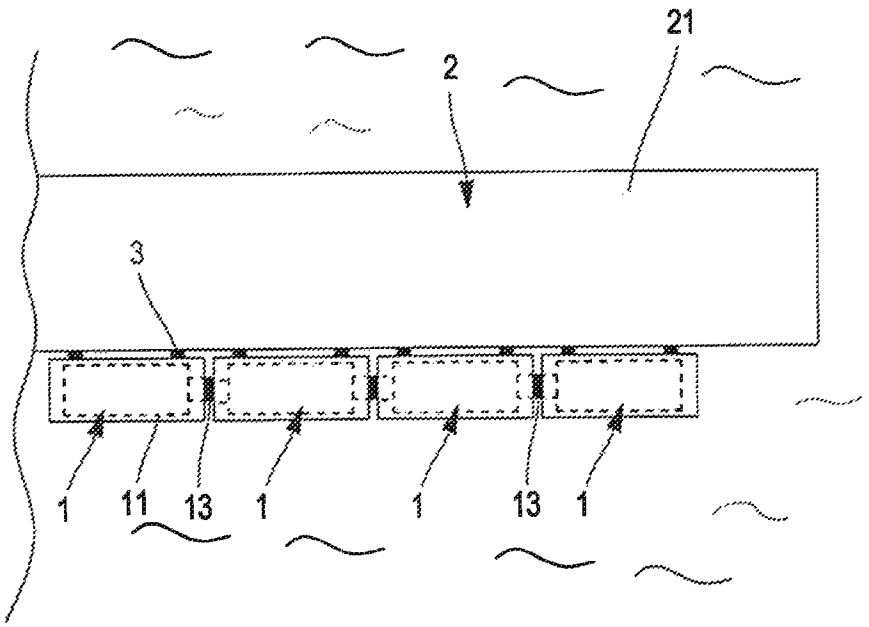

Further features and advantages will become more clearly apparent from reading the following description of one embodiment, given simply by way of illustrative and non-limiting example, and from studying the attached drawings among which:

FIG. 1 is a view in lateral section of a first embodiment of the invention; and FIG. 2 is a view from above of a second embodiment of the invention.

DETAILED DESCRIPTION

A first embodiment of the invention is now described in conjunction with FIG. 1.

As this FIG. 1 illustrates, the installation comprises a module 1 which is formed near a loading and unloading dock 2.

The dock 2 illustrated here is formed of an upper surface 21 substantially parallel to the free surface of the sea 9 and of a frontal surface 22 adjacent to the upper surface 22 and partially immersed. This dock 2 is a conventional harbour dock that can be found in most maritime ports.

The module 1 is made up of a floating caisson 10 containing a fluidtight tank 11 which may be filled with liquid fuel which, in this example, is liquefied natural gas (otherwise known as LNG). The caisson 10 has a substantially parallelepipedal closed contour formed of an upper face 100, a lower face 101 and four lateral faces 102 (two lateral faces can be seen in this section view). Edge corners 103 each having a rounded profile connect the upper 100, lower 101 faces with the four lateral faces 102 of the caisson 10. Thus, a ship 8 passing close to the module 1 runs a limited risk of significant damage to its hull in the event of an impact with the module 1 because the module does not have any "aggressive surfaces". The caisson 10 in this example has a length of 50 meters for a width of 10 meters and a height of 7 meters. According to other embodiments, the edge corners can be not rounded but some other shape, such as an edge corner at right angles or a polygonal edge corner.

In one preferred embodiment, the caisson 10 is made of marine concrete (for example cement of PM-ES class). That means that the consequences of the force due to the mass of the module 10 are limited by the reverse thrust applied by the sea. However, in other embodiments the caisson may be made from other materials such as stainless steel. For its part, the tank 11 is made of a fluidtight and preferably adiabatic material so that the liquefied natural gas is thermally insulated. In this example, it has a filling capacity of 1500 cubic meters.

The tank 11 and the caisson 10 are separated by a space in which compartments 12 can be created. These compartments 12 may for example be compartments in which safety, monitoring, cooling, pumping equipment or any other equipment of benefit to this type of installation are housed. This equipment may notably be:

- manually operated valves for isolating the pipes along which the liquid fuel flows;
- pumps immersed in the fuel and opening into these compartments, or interstitial space;
- pneumatically operated valves for opening and/or shutting off the flow;
- miscellaneous pipework;
- fuel leak detection systems;

The module 1 is therefore autonomous and does not require the addition of additional means on the dockside, except for a power source to power the module, and this is still compatible with the objectives of the invention because such a power source can easily be incorporated into the dock. Furthermore, it may be advantageous to size these compartments so that an individual can slip inside, for example in order to inspect the condition of the tanks. This module may also comprise refueling means, such as a refueling arm 81, so that the ships (which may be ferry boats or methane tankers) in dock can refuel with LNG when moored when sitting in dock. In other embodiments, provision may also be made for this module not to comprise refueling means but simply to comprise means of coupling to independent refueling means.

According to the embodiment illustrated, the module 1 is fixed to the dock 2 by anchoring means 3 (in this instance two anchoring means 3) which connect the frontal surface of the dock 22 to the lateral face 102 of the caisson 10 which faces the frontal surface 22. When the module 1 is fixed, it is at least partially immersed, which means to say that the lower face 101 is completely immersed whereas the lateral faces 102 are partially immersed in this example.

The lower face 101 of the module 1 rests on concrete columns 4 fixed to the sea bed. Advantageously, the columns 4 are secured to the module 1 and are hollow (tubes). The columns 4 further comprise means (valves, pipes, . . . ) that make it possible to create a depression in the hollow part of the column 4 using a vacuum pump.

Thus, by creating a depression in the hollow part of the columns 4, these columns sink into the sea bed. This technique is notably used for anchoring oil platforms on the sea bed.

Of course, provision may be made for the columns 4 to be placed on the sea bed before they are assembled to the module 1. The columns 4 may then be solid and made of some material other than concrete (steel . . . ).

As this FIG. 1 illustrates, the module 1 is positioned in such a way that the upper face 100 of the caisson 10 is in the continuation of the upper surface 21 of the dock 2. In this way, the module 1 forms a kind of extension to the dock 2. For that purpose, the module 1 may comprise means of connection 104 between the upper face 100 and the upper surface 21 so that these two surfaces form a continuous surface extending from the dock 2 to the module 1. The means of connection 104 may thus comprise joints and rigid plates (made for example of steel or of concrete) allowing the dock 2 to be extended to the module 1 continuously so as to allow foot or vehicular traffic to pass unimpeded from the dock 2 to the module 1.

Depending on the embodiment, provision may be made for several modules to be aligned on the end of the frontal surface of a dock. According to a second embodiment like that illustrated in FIG. 2, four modules 1 are employed positioned one after the other along a dock 2. These four modules in this example represent a capacity of around 6000 cubic meters of LNG over a total length of around 200 meters. As illustrated in that figure, these four modules are joined together by pipes 13 so that the quantity of liquid fuel contained in each module can be harmonized thereby forming a single liquid fuel storage "entity".

The modules are preferably manufactured away from the port and then, because of their buoyancy, towed to their definitive anchorage. Thus, work in the port is limited to the construction of the columns 4 and the fixing of the module to the dock. The operation is also simplified when the columns 4 are secured to the module 1 from the manufacture thereof.

Alternative forms in which the module and, more particularly, the caisson, has a contour the profile of which is not parallelepipedal but adapted to the constraints imposed by the port or by the LNG tanks may also be envisaged.

It is also possible to contemplate an embodiment in which the modules are positioned not between the dock and the ship but on the opposite side of the ship, namely on a frontal surface opposite another frontal surface facing the ship that is to be refilled. In this scenario, the refilling arm would also allow the ship to be refilled with liquid fuel.

It is finally possible to contemplate an alternative form in which the module has no space between the tank and the caisson.

The invention claimed is:

1. An installation for the in-port storage of liquid fuel, which is formed near a dock, the dock being formed of at least an upper surface substantially parallel to a free surface of seawater and a frontal surface adjacent to the upper surface and partially immersed, the installation comprising:

at least one module having a caisson containing a fluid tight tank configured to contain liquid fuel, the caisson having a closed contour having an upper face, a lower face, and several lateral faces, and the module being fixed to the dock by at least one anchor connecting one of the lateral faces of the caisson to the frontal surface of the dock, wherein the lower face and the lateral faces of the caisson are at least partially immersed, wherein the upper face of the caisson is arranged to lie in a plane substantially the same as a plane of the upper surface of the dock and wherein the installation further comprises at least one connector between the upper face and the upper surface.

2. The installation according to claim 1, wherein the lower face of the caisson rests on columns fixed to a sea bed.

3. The installation according to claim 2, wherein the columns are hollow.

4. The installation according to claim 3, wherein a space exists between the caisson and the tank.

5. The installation according to claim 4, wherein the module comprises compartments created in the space between the caisson and the tank and at least one of the compartments contains equipment.

6. The installation according to claim 5, wherein the caisson has a substantially parallelepipedal contour.

7. The installation according to claim 6, wherein the caisson is formed of concrete.

8. The installation according to claim 7, wherein the module is removably fixed to the dock.

* * * * *